US006006571A

United States Patent [19]

Wu

[11] Patent Number: 6,006,571

[45] Date of Patent: Dec. 28, 1999

[54] CHAMFERING DEVICE FOR SPRING-MAKING MACHINES

[76] Inventor: Chin-Tu Wu, P.O. Box 82-144, Taipei, Taiwan

[21] Appl. No.: 09/085,503

[22] Filed: May 27, 1998

[51] Int. Cl.[6] ..... B21F 11/00

[52] U.S. Cl. ..... 72/129; 408/203.5; 408/211

[58] Field of Search ..... 72/129, 135, 146, 72/145, 140, 137, 138, 446, 441, 447; 408/203.5, 211; 409/138, 228; 407/34, 40, 42, 47

[56] References Cited

U.S. PATENT DOCUMENTS 3,228,267 1/1966 Hebert ..... 407/34
5,054,972 10/1991 Cooney ..... 408/211
5,160,228 11/1992 Arai et al. ..... 407/34
5,452,598 9/1995 Cheng ..... 72/140
5,732,583 3/1998 Itaya ..... 72/140

*Primary Examiner*—Rodney Butler
*Attorney, Agent, or Firm*—A & J

[57] ABSTRACT

A chamfering device for a spring-making machine includes a body portion adapted to be mounted on a slide of a spring making machine and moved in unison with the slide, a motor seat fixedly mounted on an upper end of the body portion, and a motor having an output axle on which is arranged a tool holder provided with at least a cutting tool for cutting a spring wire extending into the tool holder from the spring making machine, whereby the chamfering device can be moved to align with the center of the spring making machine so as to cut a chamfer on an end of the spring wire.

4 Claims, 7 Drawing Sheets

CHAMFERING DEVICE FOR SPRING-MAKING MACHINES

BACKGROUND OF THE INVENTION

1. Field of the Invention

This invention is related to a chamfering device for spring-making machines.

2. Description of the Prior Art

The conventional spring making machine generally includes a panel on which are radially arranged a plurality of slides for mounting tools for bending a spring wire into various kinds of springs. However, the spring formed by such a machine has sharp ends which will often do injury to the user. Further, the spring wire for electronic couplings has a rectangular cross section which makes it very difficult for an operator to fit the spring into the hole of the electronic element thereby causing much inconvenience in assembly.

Therefore, it is an object of the present invention to provide a chamfering device for spring-making machines which can obviate and mitigate the above-mentioned drawbacks.

SUMMARY OF THE INVENTION

This invention is related to a chamfering device for a spring-making machine.

According to the preferred embodiment of the present invention, a chamfering device for a spring-making machine includes a body portion adapted to be mounted on a slide of a spring-making machine and moved in unison with the slide, a motor seat fixedly mounted on an upper end of the body portion, and a motor having an output axle on which is arranged a tool holder provided with at least a cutting tool for cutting a chamfer on an end of a spring wire extending into the tool holder from the spring-making machine, whereby the chamfering device can be moved to align with the center of the spring making machine so as to chamfer an end of the spring wire.

It is the primary object of the present invention to provide a chamfering device for a spring-making machine which can cut a chamfer on the end of a spring.

It is another object of the present invention to provide a chamfering device for a spring-making machine which can improve the quality of springs.

It is still another object of the present invention to provide a chamfering device for a spring-making machine which can be rapidly mounted on the slide of a conventional spring making machine.

It is still another object of the present invention to provide a chamfering device for a spring-making machine which is simple in construction.

It is a further object of the present invention to provide a chamfering device for a spring-making machine which can increase the competibility of the spring manufacturers.

DETAILED DESCRIPTION OF THE PREFERRED EMBODIMENT

Figure 1:
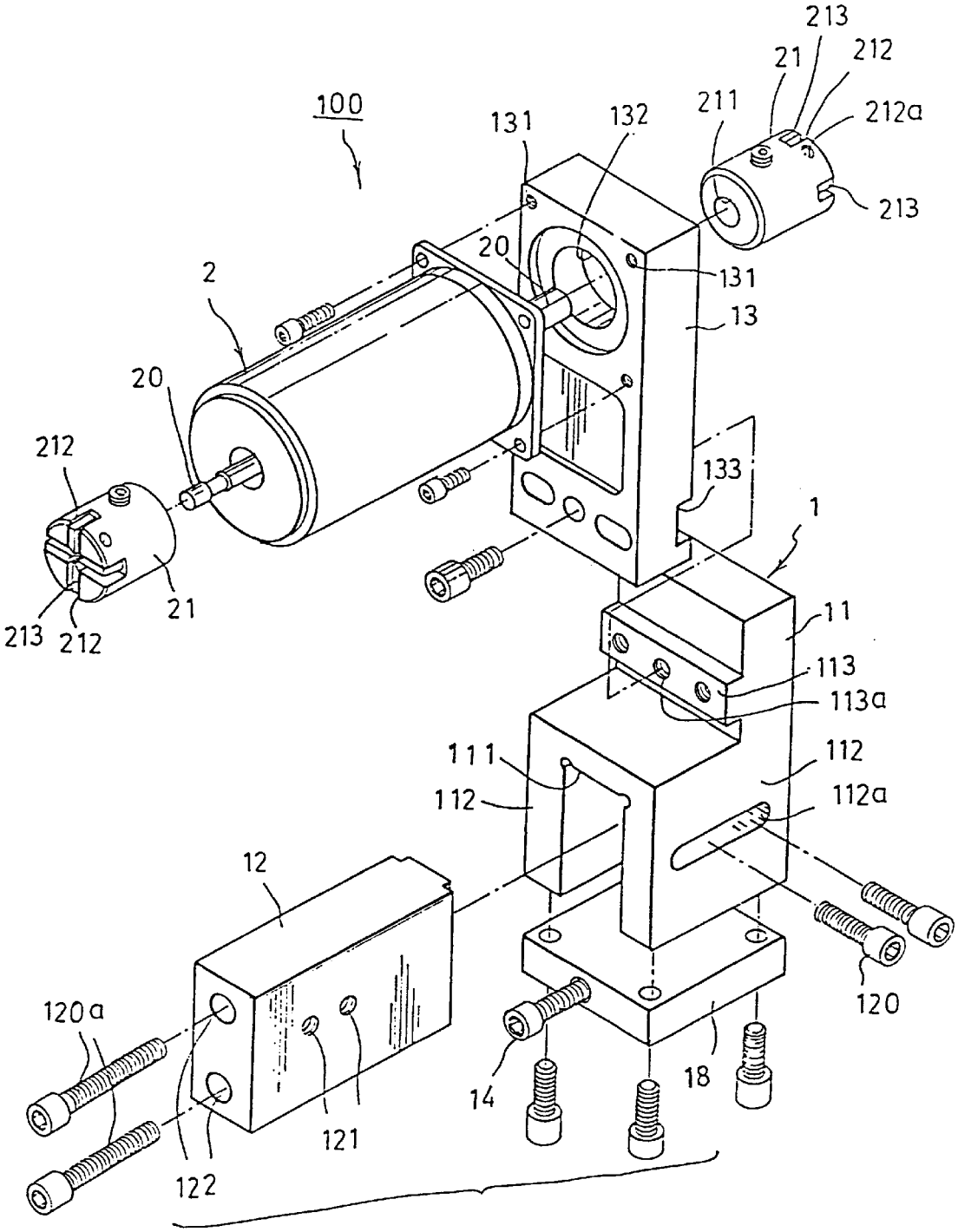
FIG. 1 is an exploded view of the present invention.

With reference to the drawings and in particular to FIGS. 1, 2, 3 and 4 thereof, the chamfering device 100 for a spring-making machine according to the present invention generally comprises a body portion 1 fixedly mounted on a slide A1 of a spring-making machine A, a motor 2 fastened on the body portion 1, and two tool holders 21 secured to two ends of an output axle 20 of the motor 2, whereby the chamfering device 100 can cut a chamfer on the end of the spring wire S as desired.

Figure 2:
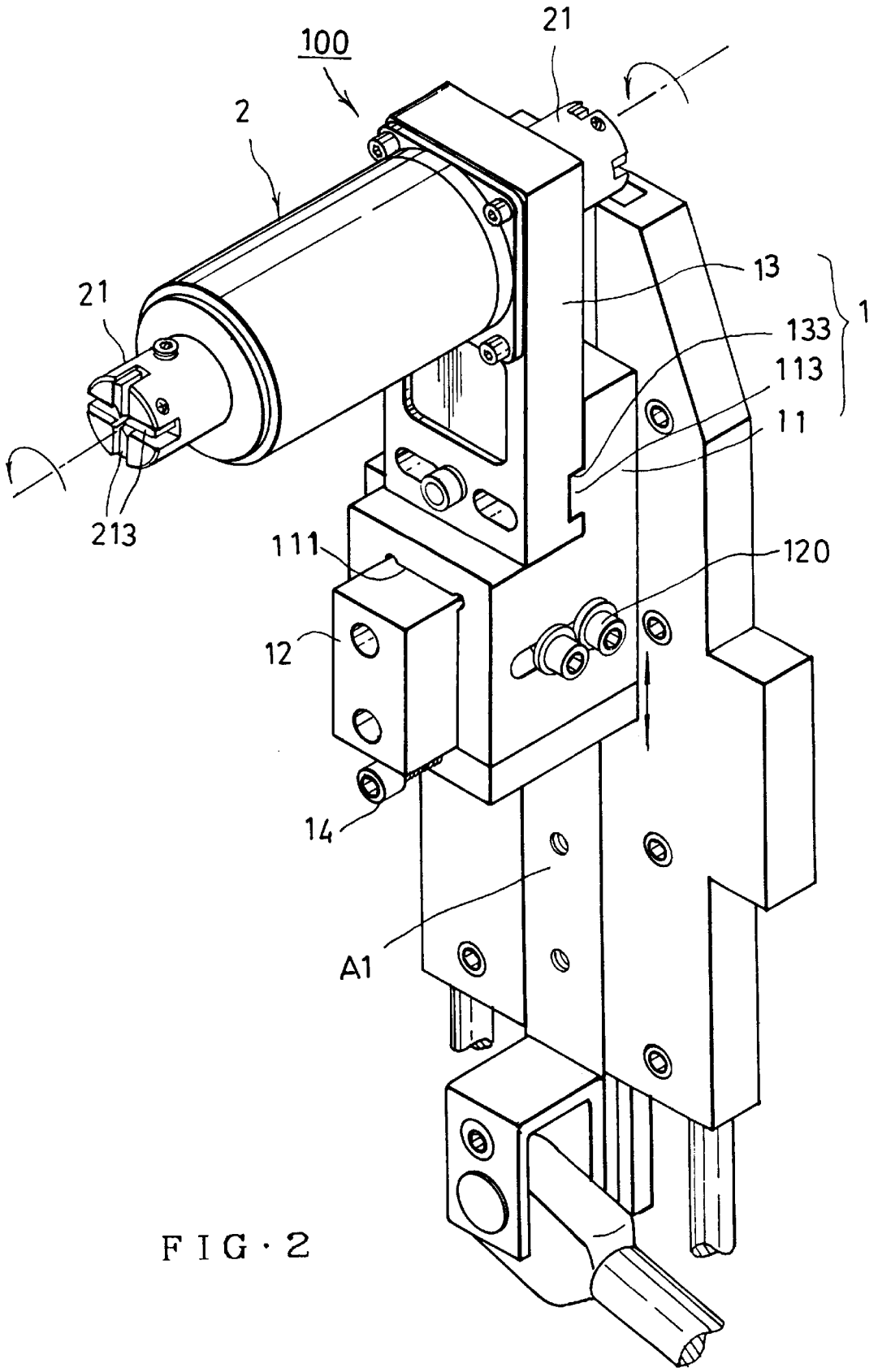
FIG. 2 is a perspective view of the present invention.
Figure 3:
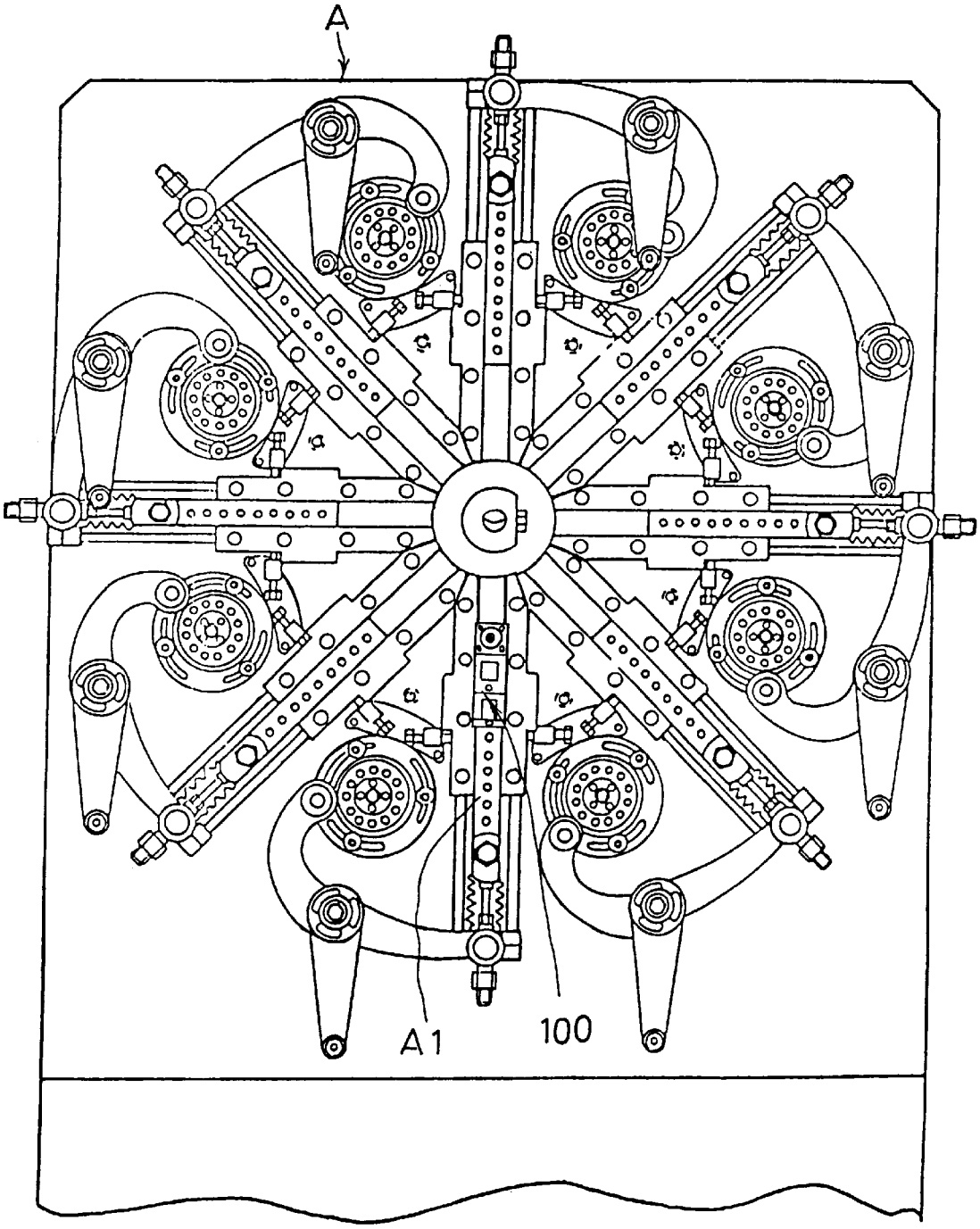
FIG. 3 illustrates how the present invention is mounted on a spring-making machine.

As shown in FIGS. 1 and 2, the body portion 1 includes a block 11, an adjusting member 12 and a motor seat 13. The block 11 has an inverted U-shaped lower portion formed with two depending legs 112 between which there is a recess 111 open at the bottom. One of the depending legs 11 has a slot 112*a* in communication with the recess 111. The adjusting member 12 is dimensioned to be slidably fitted in the recess 111. The lateral side of the adjusting member 12 has a plurality of transverse threaded holes 112*a* so that a plurality of bolts 120 can extend through the slots 112*a* to engage with the threaded holes 121 of the adjusting member 12 thereby fixing the adjusting member 12 in the recess 111. The front end of the adjusting member 12 is formed with a plurality of holes for the passage of screws 120*a* so that the adjusting member 12 can be secured to the slide A1 by the screws 120*a*. The motor seat 13 has a lower portion fixedly mounted on the upper portion of the base 1. The upper portion of the seat 13 has a plurality of threaded holes 131 for fastening the motor 2 by screws (shown but not numbered). The central portion of the motor seat 13 has an opening 132 for the passage of the output axle 20 of the motor 2.

The body portion 1 may be composed of a plurality of rectangular plates or may be a unitary member (as shown in FIGS. 1 to 4), as required. The upper part of the body portion 1 has a raised portion 113 adapted to engage with a groove 133 at the lower rear side of the motor seat 13 and formed with a plurality of threaded holes 113*a* so that the motor seat 13 can be secured to the body portion 1 by screws (shown but not numbered). A rectangular base 18 is fixedly mounted on the bottom of the body portion 1 by screws and secured to the slide A1 by a screw 14. By means of the bolt 14, the body portion 1 and the motor seat 13 can be adjusted in position along the slide A1.

Figure 4:
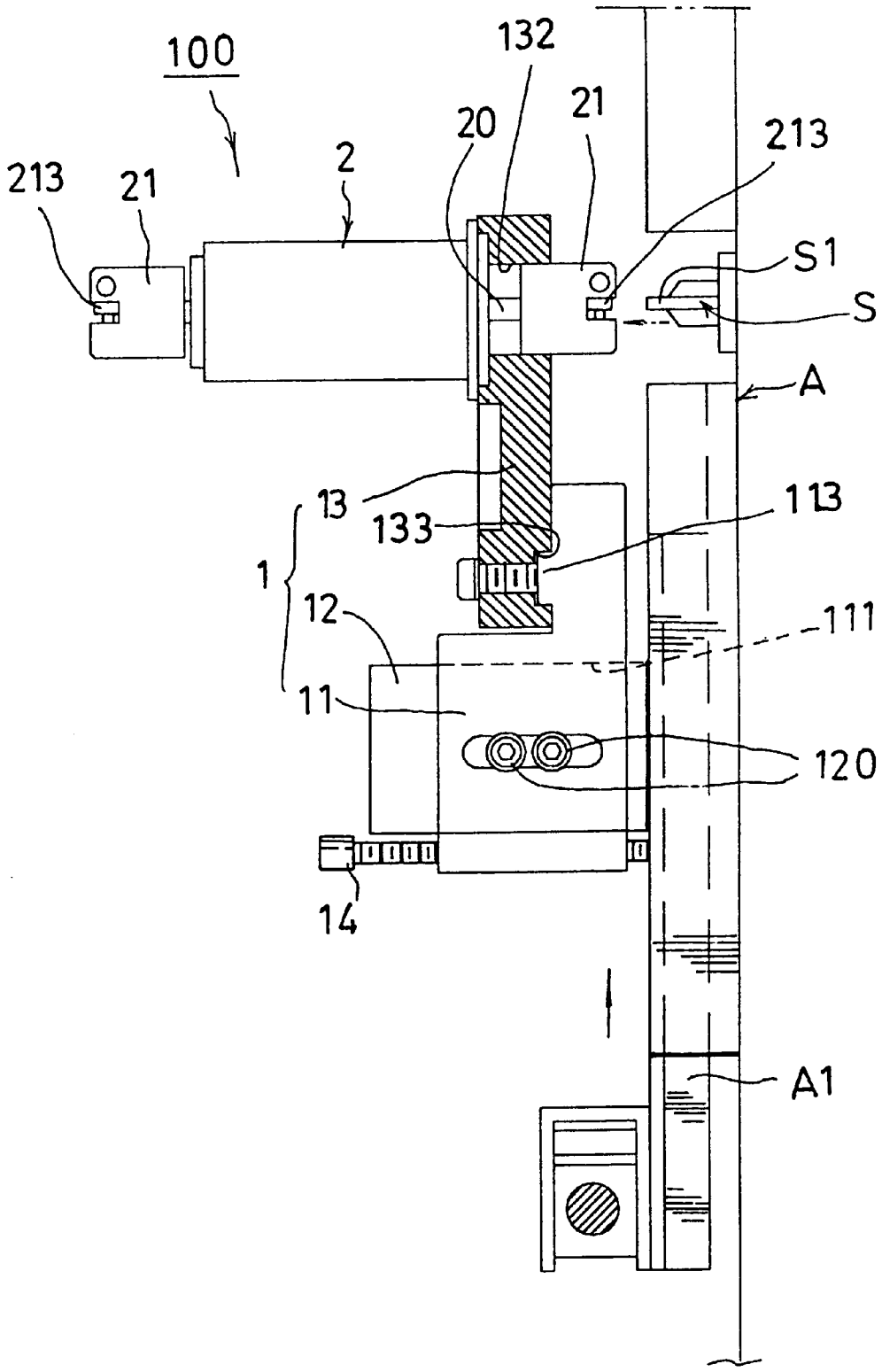
FIG. 4 is a sectional side view of the present invention.
Figure 5:
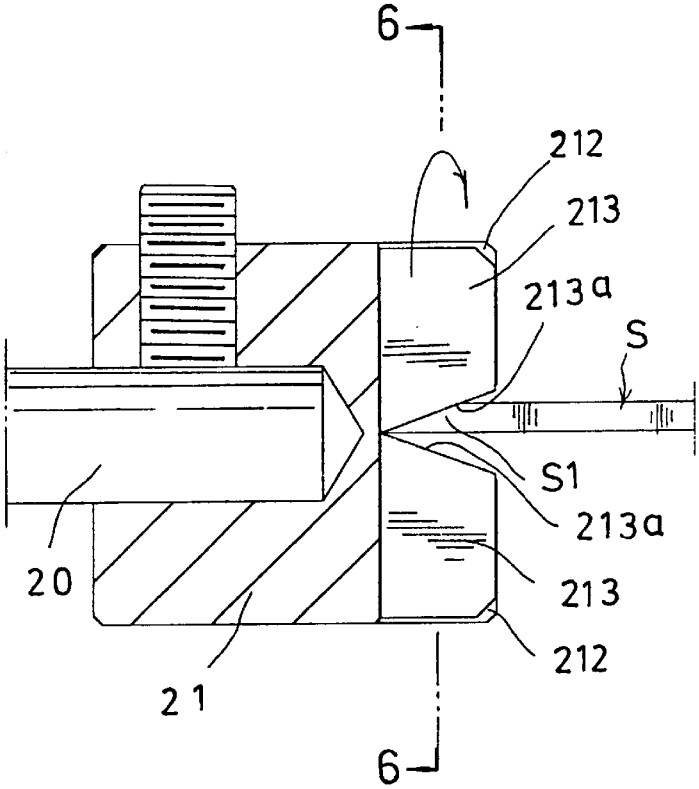
FIG. 5 is a sectional view of the tool holder.
Figure 6:
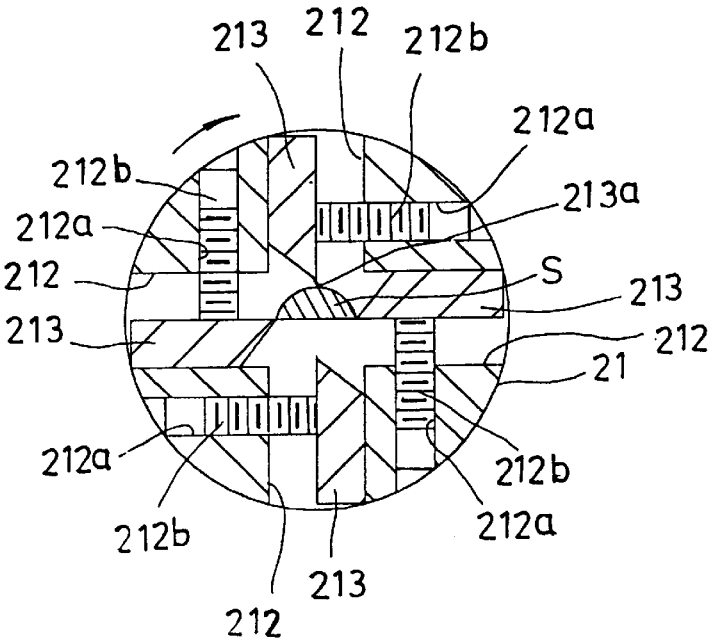
FIG. 6 is a sectional view taken along line 6—6 of FIG. 5.

Referring to FIGS. 1, 2, 4, 5 and 6, the tool holder 21 mounted on each end of the output axle 20 of the motor 2 includes a center hole 211 at an end adapted to receive an end of the output axle 20, a plurality of radial slots 212 at another end, a plurality of threaded holes 212*a*, a plurality of cutting tools 213 fitted in the threaded holes 212*a*, and a plurality of screws 212*b* engaged with the threaded holes 212*a* to bear against the cutting tools 213. As shown in FIGS. 5 and 6, when a spring wire S gradually extends into the tool holder 21, the knife edges 213*a* of the cutting tools 213 will be rotated to cut a chamfer on the spring wire S. The angle of the chamfer on the end of the spring depends upon the inclination of the knife edge of the cutting tools 213.

Referring to FIG. 6, the tool holder 21 is formed with four radial slots 212 in each of which is fitted a cutting tool 213 fastened by a screw 212*b*. The cutting tools 213 are fixedly mounted in the tool holder 21 so that the cutting tools 213 will be rotated with the output axle 20 of the motor 2 to chamfer the end of the spring wire S.

Figure 7:
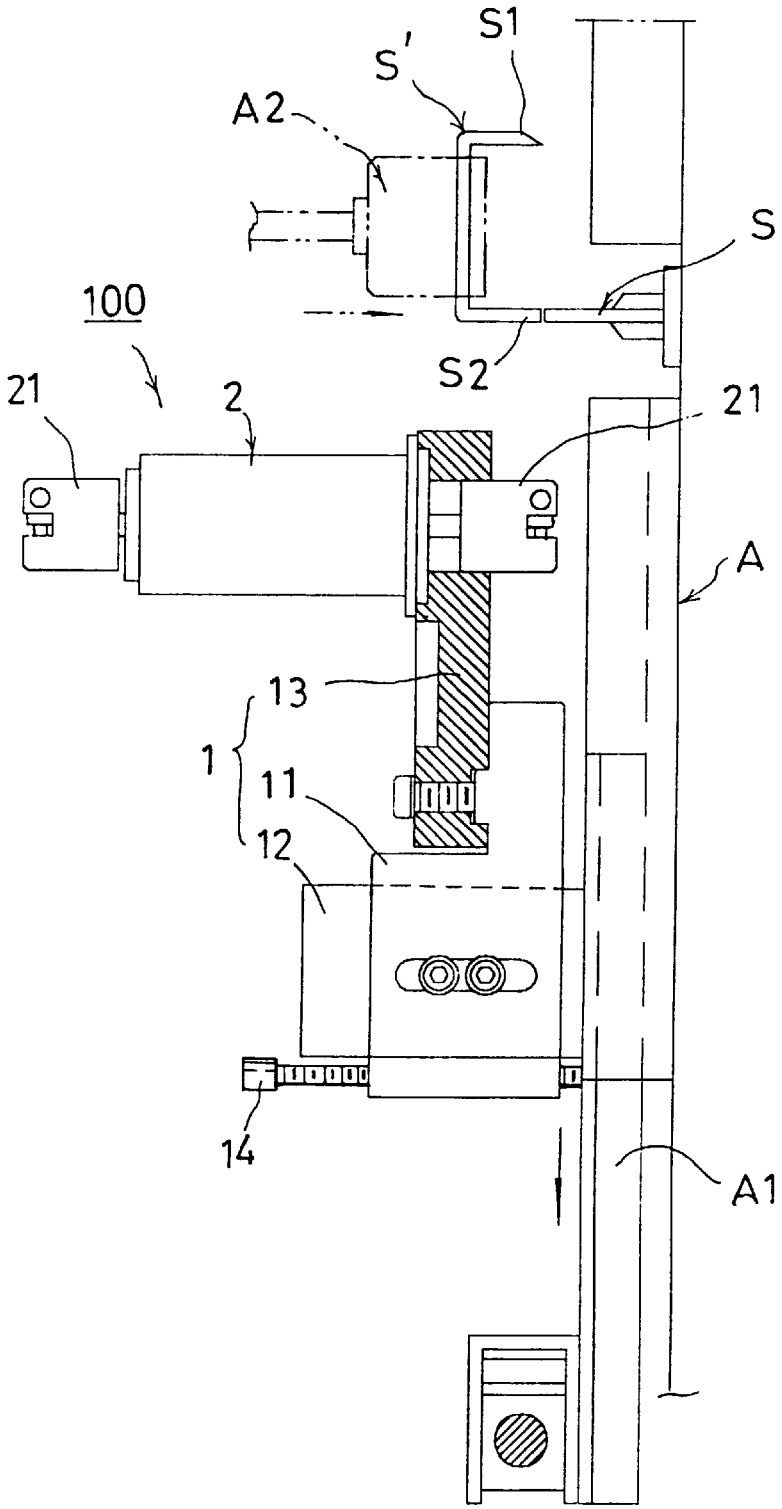
FIG. 7 shows that the present invention is moved away from the spring wire.
Figure 8:
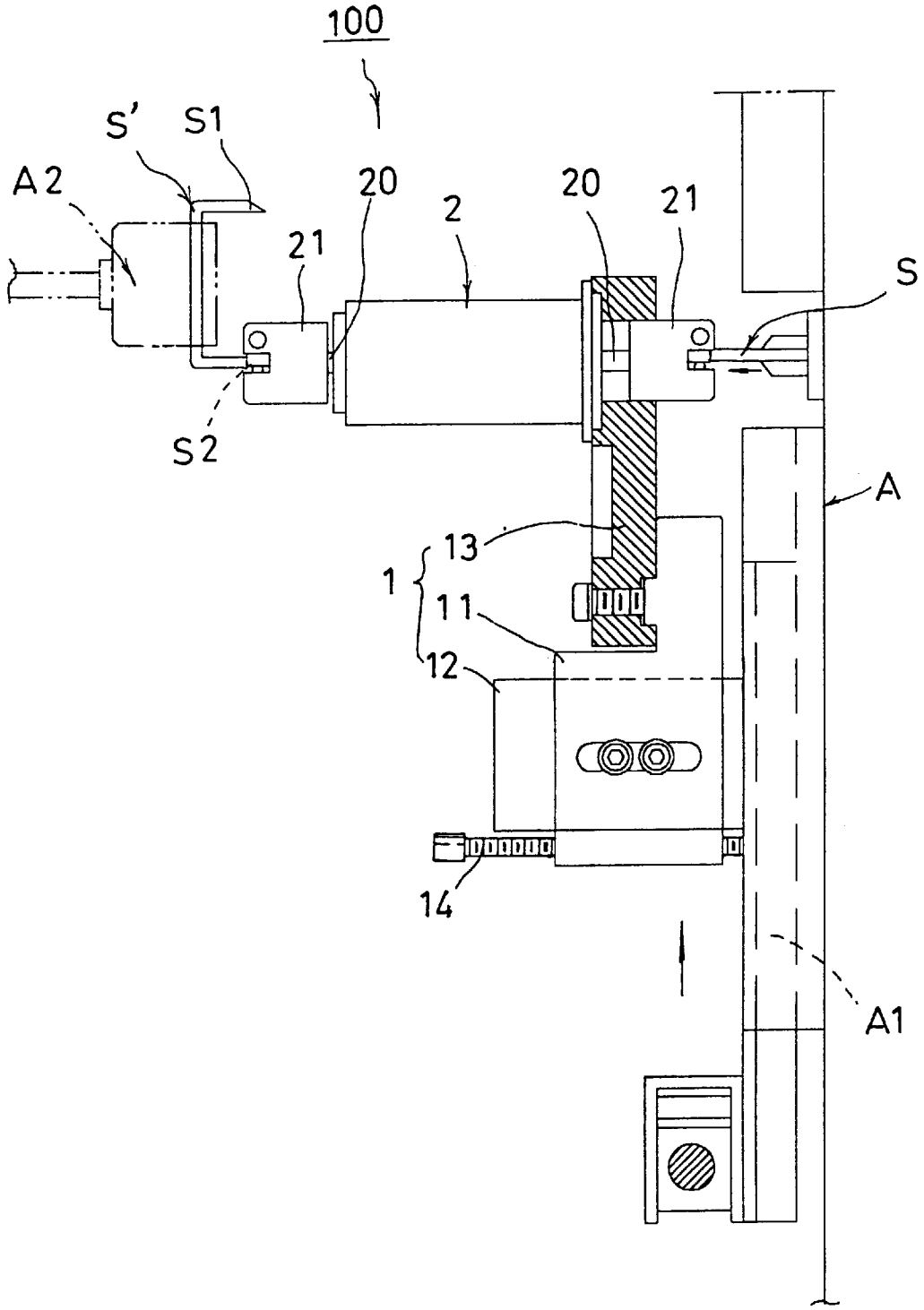
FIG. 8 shows that the present invention is moved toward the spring wire.

As shown in FIG. 4, since the chamfering device 100 is fixedly mounted on the slide A1, the body portion 1, the motor 2 and the tool holders 21 will be moved in unison with the slide A1. When in use, the slide A1 is first moved to make the tool holder 21 align with the spring wire outlet of the spring making machine A. Then, the motor 2 is turned on to rotate the tool holder 21 and the spring wire S is gradually pushed into the tool holder 21 thereby cutting a chamfer on an end S1 of the spring wire S. Thereafter, the spring wire S will be withdrawn into the spring making machine A and the slide A1 together with the chamfering device 100 will be moved away from the central position of the spring making machine A. Then, the spring wire S will be again pushed out of the spring-making machine A for bending into a spring. With reference to FIG. 7, when the spring wire S is bent into an inverted U-shaped spring S', a clamp A2 will be driven by a hydraulic device (not shown) to hold the spring S' so that the clamp A2 can move the spring S' away from the spring-making machine when the spring wire S is cut off. Then, the slide A1 is moved upwardly to make the tool holders 21 align with the center of the spring-making machine A and the clamp A2 is moved against the tool holder 21 mounted on the outer end of the output axle 20 of the motor 2, with the other end S2 of the spring S' extending into the tool holder 21. In the meantime, a spring wire S extends out of the spring-making machine A into the tool holder 21 mounted on the inner end of the output axle 20 of the motor 2. As such, the present invention can cut a chamfer on the end of two springs simultaneously thus increasing the working efficiency.

The spring chamfered by the present invention will be easy to fit into a hole thereby facilitating the assembly, improving quality of the spring and increasing competitability of the spring manufacturers.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A chamfering device for a spring making machine comprising:

a body portion mounted on a slide of a spring making machine and moved in unison with said slide;

a motor seat fixedly mounted on an upper end of said body portion; and a motor, mounted on said motor seat, having an output axle on which is arranged a tool holder provided with at least a cutting tool for cutting a spring wire extending into said tool holder from said spring making machine, said tool holder having an inner recess for receiving an end portion of said spring wire.

2. The chamfering device for a spring.making machine as claimed in claim 1, wherein said body portion includes a base having a recess in which is fitted an adjusting slide, said base having one side formed with an elongated slot in communication with said recess, said adjusting slide having a plurality of transverse threaded holes aligned with said elongated slot and a plurality of longitudinal through holes, a plurality of first screws extending through said elongated slot to engage with said transverse threaded holes, and a plurality of second screws extending through said through holes to engage with a slide seat, said motor seat having a lower portion bolted on said base and an upper portion formed with a plurality of threaded holes for fixing said motor and an opening for passage of said output axle of said motor.

3. The chamfering device for a spring making machine as claimed in claim 1, wherein said body portion has an upper portion formed with a raised seat and said motor seat has a groove dimensioned to receive said raised seat.

4. The chamfering device for a spring making machine as claimed in claim 1, wherein said tool holder includes an axial hole receiving an end of said output shaft of said motor, at least a slot in which is fitted a cutting tool, and a screw extending into said slot to fix said cutting tool in position.

* * * * *